US009033432B2

(12) United States Patent
Kilic et al.

(10) Patent No.: US 9,033,432 B2
(45) Date of Patent: May 19, 2015

(54) DISHWASHER

(75) Inventors: Osman Kilic, Istanbul (TR); Salih Goksu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 0 days.

(21) Appl. No.: 14/129,894

(22) PCT Filed: Jun. 27, 2012

(86) PCT No.: PCT/EP2012/062519

§ 371 (c)(1),
(2), (4) Date: Dec. 27, 2013

(87) PCT Pub. No.: WO2013/000978

PCT Pub. Date: Jan. 3, 2013

(65) Prior Publication Data

US 2014/0132136 A1 May 15, 2014

(30) Foreign Application Priority Data

Jun. 27, 2011 (TR) ..... a 2011 06334

(51) Int. Cl.
*A47B 77/08* (2006.01)
*A47L 15/50* (2006.01)

(52) U.S. Cl.
CPC ..... *A47L 15/503* (2013.01)

(58) Field of Classification Search
CPC .... A47L 15/507; A47L 15/4246; F25D 25/02
USPC ..... 312/228, 228.1, 408; 108/69, 77, 78, 108/90, 92, 143; 211/41.8, 41.9
See application file for complete search history.

(56) References Cited

U.S. PATENT DOCUMENTS

| | | | | |
|---|---|---|---|---|
| 3,934,728 | A * | 1/1976 | Guth | 211/41.9 |
| 5,287,984 | A * | 2/1994 | Michael | 220/812 |
| 7,665,475 | B2 * | 2/2010 | Hedstrom et al. | 134/134 |
| 7,766,175 | B2 * | 8/2010 | Jadhav et al. | 211/41.9 |
| 2001/0000901 | A1 * | 5/2001 | Kambouris et al. | 220/212 |
| 2011/0133614 | A1 * | 6/2011 | Bastuji | 312/228.1 |

FOREIGN PATENT DOCUMENTS

| | | | |
|---|---|---|---|
| DE | 3417744 | A1 | 11/1985 |
| DE | 19540611 | A1 | 5/1997 |
| DE | 29621528 | U1 | 4/1998 |
| EP | 1275336 | A1 | 1/2003 |
| EP | 1413241 | A1 | 4/2004 |
| EP | 1475030 | A2 | 11/2004 |

OTHER PUBLICATIONS

International Search Report for PCT/EP2012/062519, Dec. 12, 2012.

* cited by examiner

*Primary Examiner* — Matthew Ing
(74) *Attorney, Agent, or Firm* — Venjuris P.C.

(57) ABSTRACT

What is described is a dishwasher (1) comprising a body (2), at least one rack (3) placed into the body (2), having a base and side walls (4) surrounding the base and wherein the objects to be washed are placed, at least one shelf (7), mounted to the side walls (4) of the rack (3), having a carrying surface (5) whereon kitchenware like cups, glasses etc can be placed. At least one slot (8) with both ends closed is located on the shelf (7) and an auxiliary element (10) having at least one pin (9) that can both rotate and slide inside the slot (8) is folded over the carrying surface (5) by being rotated around the pin (9) when the pin (9) is rested against any end of the slot (8).

12 Claims, 5 Drawing Sheets

DISHWASHER

Figure 1:
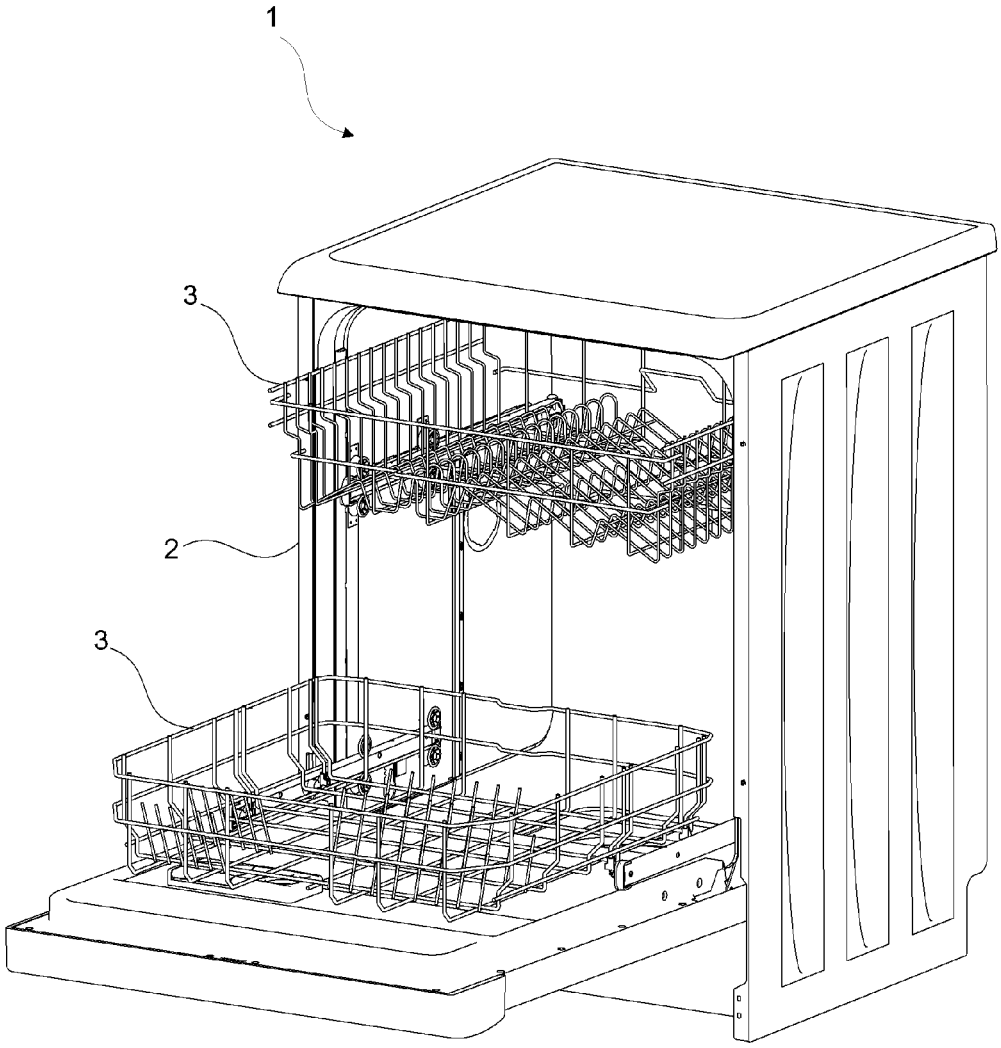

The present invention relates to a dishwasher comprising a shelf, mounted on the rack and whereon the objects to be washed are placed.

In dishwashers, shelves are used, that are mounted to the side wall of the rack, whereon especially small volume objects like glass, bowl, and cutlery are placed in order to provide effective utilization of the washing space. However, when lightweight and/or small items are placed on the shelf, they can fall into the rack during washing. This results in ineffective cleaning of the lightweight objects.

In the state of the art German Patent Application No. DE19540611, a dishwasher is described that comprises a holder, the surface area of which can be changed and that is mounted to the side wall of the rack.

The aim of the present invention is the realization of a dishwasher providing effective cleaning of lightweight and/or small objects.

The dishwasher realized in order to attain the aim of the present invention, explicated in the first claim and the respective claims thereof, comprises a shelf mounted to the side walls of the rack and an auxiliary element mounted on the shelf. The shelf has a carrying surface whereon the objects to be washed are placed. Slots with both ends closed are located on the shelf. The shelf and the auxiliary element are shaped almost rectangular. The mounting of the auxiliary element on the shelf is realized by fitting the pins, that are located at the portion of the auxiliary element near the rear end of its side walls, into the slots. The pins can make both rotational and sliding movements inside the slots. When the pins bear against any end of the slot, the auxiliary element is folded over the carrying surface as the pins are rotated in the slots. Thus, lightweight and/or small objects can be washed by tucking in between the carrying surface and the auxiliary element. The auxiliary element provide the lightweight objects to be held on the carrying surface by folding over them. Consequently, this type of objects are prevented from falling into the rack and provided to be cleaned effectively.

The auxiliary element furthermore can be moved forwards/backwards by sliding the pins inside the slots. The auxiliary element is provided to extend towards the interior of the rack by moving the pins inside the slots towards the interior of the rack and thus the loading area of the carrying surface is widened. Thus, big sized objects are enabled to be placed on the carrying surface and the auxiliary element. While the auxiliary element is extended into the rack, at least some portion of the auxiliary element rests on the carrying surface. Accordingly, the weight of the auxiliary element is provided to be supported by the carrying surface and the auxiliary element is positioned in the rack in a balanced manner.

In an embodiment of the present invention, the flanges that are located at two opposite sides of the carrying surface, extend upwards from the carrying surface. The slots are situated on the flanges and the pins are placed into the slots. Thus, in either case, at least some portion of the auxiliary element is enabled to remain on the carrying surface.

In another embodiment of the present invention, the auxiliary element remains between the flanges. Thus, both rotational and sliding movements of the pins inside the slot is made easier.

In another embodiment of the present invention, the slot is configured as a cut-out situated on the flange. Thus, the pins can be fitted into the slots more easily. Consequently, mounting of the auxiliary element on the shelf is made easier.

In another embodiment of the present invention, the slots are located at the inner surfaces of the flange facing each other.

In an embodiment of the present invention, the slot is configured to be inclined with respect to the carrying surface. In other words, the slot is positioned diagonally on the flange. Consequently, when the auxiliary element is folded over the carrying surface, a gap is formed between the carrying surface and the auxiliary element wherein small sized objects can be placed.

In another embodiment of the present invention, a skirt is located on the side of the auxiliary element facing inside the rack which extends upwards. When the pins bear against the end of the slots near the interior of the rack and the auxiliary element is folded over the carrying surface, the skirt remains in vertical position with respect to the carrying surface. Thus, a difference in height is formed between the carrying surface and the auxiliary element. Thusly, a space is created between the carrying surface and the auxiliary element wherein small objects can be placed.

In another embodiment of the present invention, the dishwasher comprises more than one protrusion situated on the auxiliary element which enables placing of cutlery items therebetween. The cutlery items are tucked in between the protrusions hence preventing them from contacting each other. Consequently, these objects are provided to be cleaned more effectively.

By means of the present invention, the lightweight and/or small objects are prevented from falling into the rack or the body during washing and provided to be held on the shelf where they are placed. These objects are provided to be cleaned more effectively by tucking in between the carrying surface of the shelf and the auxiliary element.

The model embodiments relating to the dishwasher realized in order to attain the aim of the present invention are illustrated in the attached figures, where:

FIG. 1—is the perspective view of a dishwasher.

Figure 2:
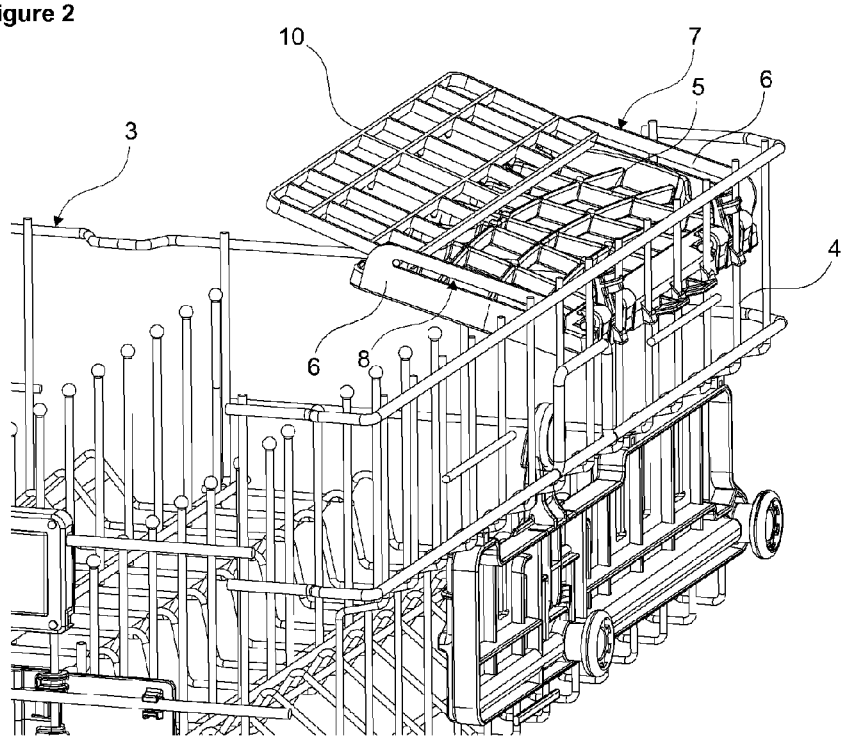

FIG. 2—is the perspective view of a rack, the shelf and the auxiliary element when the auxiliary element is extended into the rack.

Figure 3:
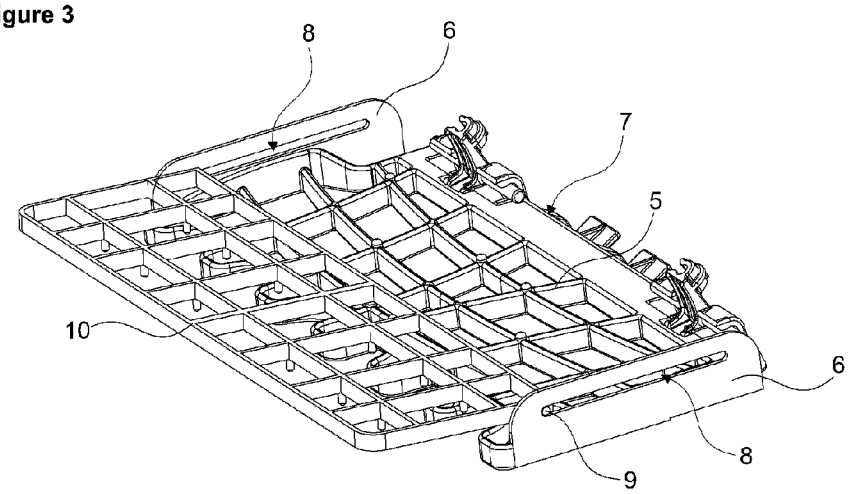

FIG. 3—is the perspective view of the shelf and the auxiliary element when the auxiliary element is extended into the rack.

Figure 4:
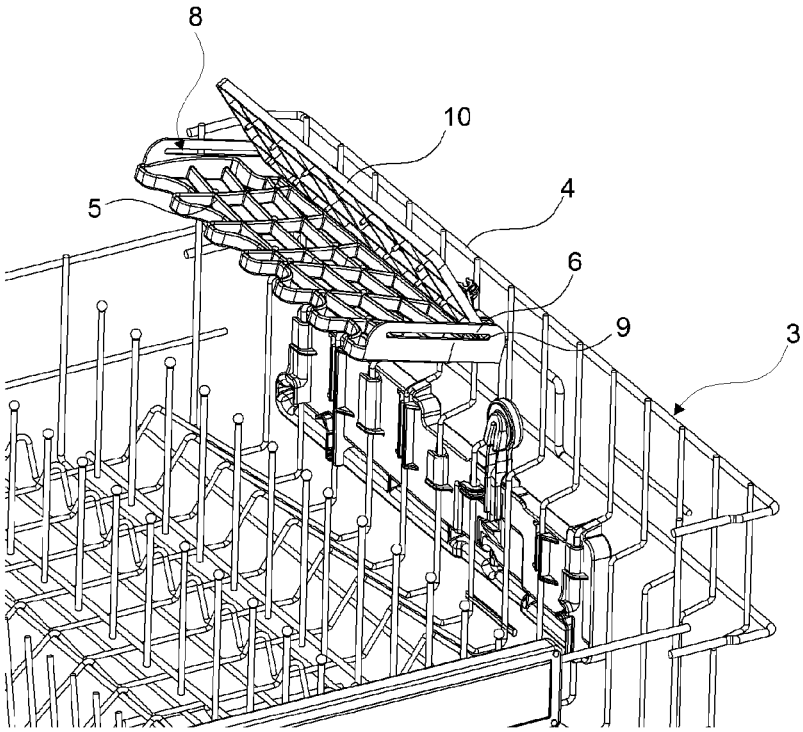

FIG. 4—is the perspective view of a rack, the shelf and the auxiliary element when the auxiliary element is folded over the carrying surface by the pins bearing against the end of the slots near the side wall.

Figure 5:
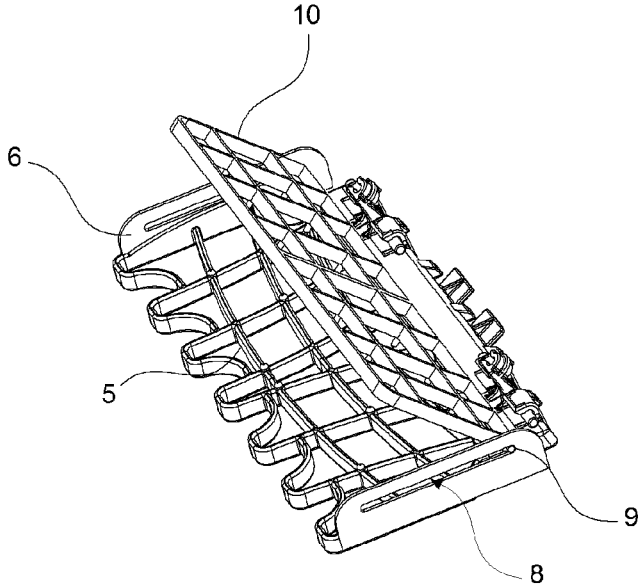

FIG. 5—is the perspective view of the shelf and the auxiliary element when the auxiliary element is folded over the carrying surface by the pins bearing against the end of the slots near the side wall.

Figure 6:
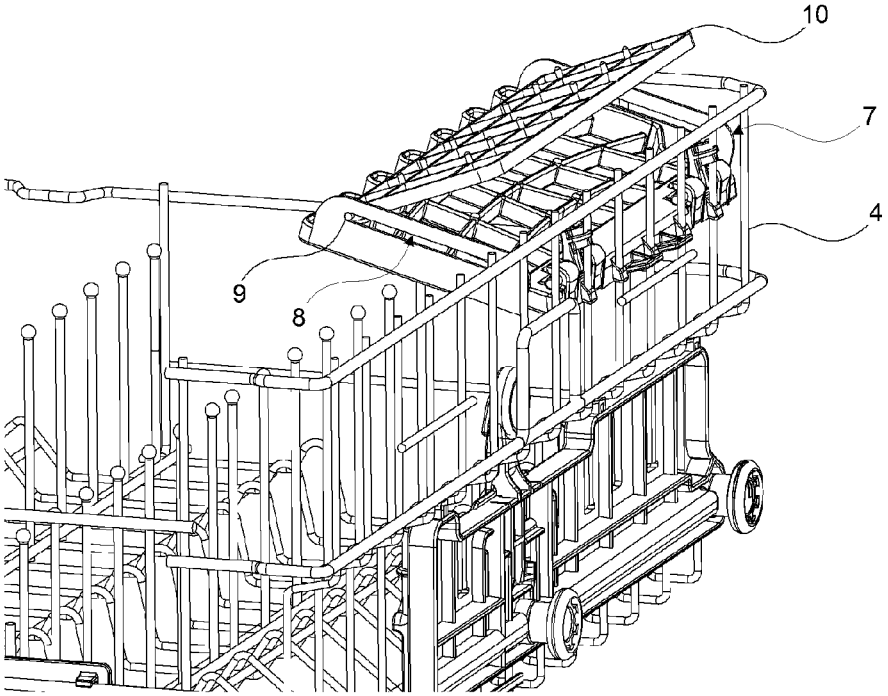

FIG. 6—is the perspective view of a rack, the shelf and the auxiliary element when the auxiliary element is folded over the carrying surface by the pins bearing against the ends of the slots near the interior of the rack.

Figure 7:
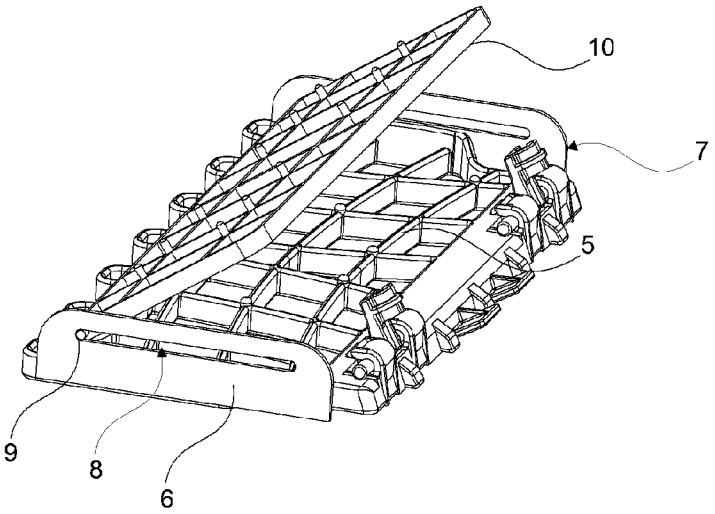

FIG. 7—is the perspective view of the shelf and the auxiliary element when the auxiliary element is folded over the carrying surface by the pins bearing against the ends of the slots near the interior of the rack.

Figure 8:
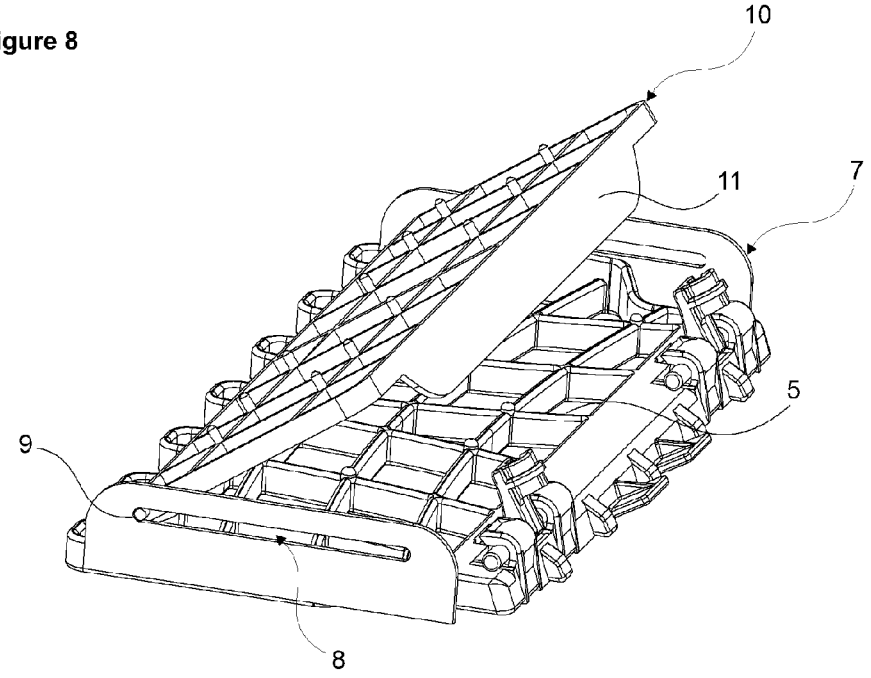

FIG. 8—is the perspective view of the shelf and the auxiliary element when the auxiliary element is extended towards the interior of the rack relating to an embodiment of the present invention.

Figure 9:
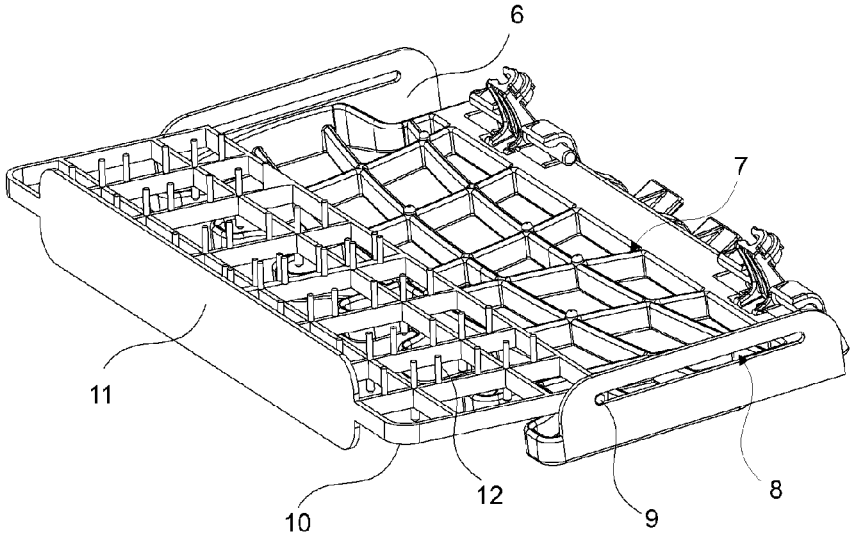

FIG. 9—is the perspective view of the shelf and the auxiliary element when the auxiliary element is extended towards the interior of the rack relating to another embodiment of the present invention.

The elements illustrated in the figures are numbered as follows:

1. Dishwasher
2. Body
3. Rack
4. Side wall
5. Carrying surface
6. Flange
7. Shelf
8. Slot
9. Pin
10. Auxiliary element
11. Skirt
12. Protrusion The dishwasher (1) comprises a body (2), at least one rack (3), placed into the body (2), having a base and side walls (4) surrounding the base and wherein the objects to be washed are placed, at least one shelf (7), mounted to the side walls (4) of the rack (3), having a carrying surface (5) whereon kitchenware like cups, glasses etc can be placed, at least one slot (8) with both ends closed, located on the shelf (7) and an auxiliary element (10) having at least one pin (9) that can both rotate and slide inside the slot (8), that is folded over the carrying surface (5) by being rotated around the pin (9) when the pin (9) is rested against any end of the slot (8).

The auxiliary element (10) is mounted on the shelf (7) by fitting the pins (9) into the slots (8). A pin (9) is disposed on each of both sides of preferably the rear edge of the auxiliary element (10). The pins (9) are moved from one end of the slots (8) to the other end by being slid. The pins (9), when rested against any end of the slots (8), are rotated inside the slots (8) to change the position of the auxiliary element (10) with respect to the shelf (7). After resting against the end of the slots (8) near the interior of the rack (3), the pins (9) are rotated around itself and the auxiliary element (10) is folded over the carrying surface (5). Thus, it becomes possible to wash the small sized or lightweight objects by squeezing them in between the carrying surface (5) and the auxiliary element (10). Accordingly, the lightweight objects are prevented from falling into the rack (3) during washing and are provided to be cleaned effectively.

Similarly, the auxiliary element (10) is folded over the carrying surface (5) by bearing the pins (9) against the end of the slots (8) near the side wall (4). Thus, some of the lightweight objects with surface area larger than the area of the carrying surface (5) are provided to be placed between the carrying surface (5) and the auxiliary element (10) so as to extend into the rack (3). Consequently, the lightweight objects like plastic covers are prevented from falling by the impact force of water during washing and provided to be washed effectively.

The auxiliary element (10) widens the loading area of the carrying surface (5) by extending towards the interior of the rack (3) such that at least some portion is seated on the carrying surface (5) by sliding of the pin (9) inside the slot (8) towards the interior of the rack (3). By at least some portion of the auxiliary element (10) being seated on the carrying surface (5), the weight of the auxiliary element (10) is provided to be supported by the carrying surface (5). Thus, the objects that are to be loaded especially on the auxiliary element (10) are provided to be supported in a balanced manner.

The loading area is formed for objects that have a larger area than the area of the carrying surface (5) by at least some portion of the auxiliary element (10) being extended into the rack (3). The loading area of desired width is created by sliding the pins (9) inside the slots (8) towards the interior of the rack (3). The auxiliary element (10) and the carrying surface (5) are positioned to be side by side so that some portion of the auxiliary element (10) remains on the carrying surface (5). In this position, the auxiliary element (10) is in an almost parallel position to the carrying surface (5).

When the auxiliary element (10) is desired to be detached from the shelf (7), one of the pins (9) bears against one end of the slot (8) wherein it is inserted, the other pin (9) is moved in the slot (8) in the opposite direction of the pin (9) that is kept immovable in the slot (8) wherein it is inserted. Thus, the auxiliary element (10) can be easily detached from the shelf (7) when not desired to be used.

In an embodiment of the present invention, the dishwasher (1) comprises more than one flange (6) disposed at two opposite sides of the carrying surface (5), extending upwards from the carrying surface (5). During the movement of the pins (9) inside the slots (8), the auxiliary element (10) moves on the carrying surface (5). During folding of the auxiliary element (10) over the carrying surface (5), the auxiliary element (10) shifts to angular position with respect to the carrying surface (5) as the pins (9) are rotated inside the slots (8). When the auxiliary element (10) is folded over the carrying surface (5), the auxiliary element (10) and the carrying surface (5) are almost parallel to each other. The process of changing the position of the auxiliary element (10) with respect to the carrying surface (5) is made easier by means of the flanges (6) extending upwards from the carrying surface (5).

In another embodiment of the present invention, the slots (8) are located on the flanges (6) and the pins (9) are inserted into the slots (8) such that the auxiliary element (10) remains between the flanges (6). By means of the slots (8) being located on the flanges (6), the slots (8) are also provided to be situated at a higher level than the carrying surface (5). Thus, at least some portion of the auxiliary element (10) is enabled to always remain on the carrying surface (5). Thus, the auxiliary element (10) is fixed on the shelf (7). The flanges (6) are situated on two opposite sides of the auxiliary element (10) in any case.

In another embodiment of the present invention, the slot (8) is configured to be hollow. Inserting the pins (9) into the slots (8) is made easier since the slots (8) are hollow. Thus, the problems that may arise during insertion of pins (9) into the slots (8) originating from tolerance defects that can occur during production of the pins (9) are also eliminated.

In another embodiment of the present invention, the slot (8) is located at the inner surface of the flange (6). Thus, the pins (9) are provided to bear against the inner surface of the flanges (6) that form the base of the slots (8).

In another embodiment of the present invention, the slot (8) is configured to be inclined with respect to the carrying surface (5). The end points of the slots (8) that are near the side wall (4) are at a higher level than the end points close to the interior of the rack (3) Thus, when the auxiliary element (10) is folded over the carrying surface (5) by bearing the pins (9) against the ends of the slots (8) near the interior of the rack (3), a gap remains between the auxiliary element (10) and the carrying surface (5). Consequently, it becomes easier to place small objects between the auxiliary element (10) and the carrying surface (5).

In another embodiment of the present invention, the dishwasher (1) comprises a skirt (11) that is located on the side of the auxiliary element (10) facing inside the rack (3) and which extends upwards. When the auxiliary element (10) and the carrying surface (5) are positioned to be parallel to one another, the skirt (11) functions as a barrier for the objects placed on the auxiliary element (10) and prevents these objects from falling into the rack (3). Thus, when the auxiliary element (10) is folded over the carrying surface (5) by bearing the pins (9) against the ends of the slots (8) near the interior of the rack (3), the skirt (11) is in vertical position with respect to the carrying surface (5). In this position, the skirt (11), the flanges (6), the auxiliary element (10) and the carrying surface (5) form an approximately closed volume. Thus, the small sized kitchenware is placed into this closed volume.

In another embodiment of the present invention, the dishwasher (1) comprises more than one protrusion (12) situated on the auxiliary element (10) which enables the cutlery items to be placed therebetween. The cutlery items are provided to be placed between each two protrusions (12) extending parallel to each other and hence the forks and spoons are cleaned effectively without contacting each other.

By means of the present invention, the small sized objects placed on the shelf (7) are prevented from falling into the rack (3) during washing. By folding the auxiliary element (10) over the carrying surface (5), the small objects are provided to be tightly placed between the auxiliary element (10) and the carrying surface (5) and to effectively clean these objects.

It is to be understood that the present invention is not limited to the embodiments disclosed above and a person skilled in the art can easily introduce different embodiments. These should be considered within the scope of the protection postulated by the claims of the present invention.

The invention claimed is:

1. A dishwasher (1) comprising—a body (2),—at least one rack (3) placed into the body (2), having a base and side walls (4) surrounding the base and wherein the objects to be washed are placed,—at least one shelf (7), mounted to the side walls (4) of the rack (3), having a carrying surface (5) whereon kitchenware like cups, glasses etc can be placed, characterized by—at least one slot (8) with both ends closed, located on the shelf (7) and—an auxiliary element (10) having at least one pin (9) that can both rotate and slide inside the slot (8), that is folded over the carrying surface (5) by being rotated around the pin (9) when the pin (9) is rested against any end of the slot (8), wherein the slot (8) is inclined with respect to the carrying surface (5).

2. The dishwasher (1) as in claim 1, wherein the auxiliary element (10) that widens the loading area of the carrying surface (5) by extending towards the interior of the rack (3) such that at least some portion is seated on the carrying surface (5) by sliding the pin (9) inside the slot (8) towards the interior of the rack (3).

3. The dishwasher (1) as in claim 1, wherein more than one flange (6) disposed at two opposite sides of the carrying surface (5) and which extends upwards from the carrying surface (5).

4. The dishwasher (1) as in claim 1, wherein the slot (8) located on the flange (6) and the pin (9) that is inserted into the slot (8) such that the auxiliary element (10) remains between the flanges (6).

5. The dishwasher (1) as in claim 1, wherein the slot (8) is hollow.

6. The dishwasher (1) as in claim 1, wherein the slot (8) which is located at the inner surface of the flange (6).

7. A dishwasher (1) comprising—a body (2),—at least one rack (3) placed into the body (2), having a base and side walls (4) surrounding the base and wherein the objects to be washed are placed,—at least one shelf (7), mounted to the side walls (4) of the rack (3), having a carrying surface (5) whereon kitchenware like cups, glasses etc can be placed, characterized by—at least one slot (8) with both ends closed, located on the shelf (7) and—an auxiliary element (10) having at least one pin (9) that can both rotate and slide inside the slot (8), that is folded over the carrying surface (5) by being rotated around the pin (9) when the pin (9) is rested against any end of the slot (8) and wherein the auxiliary element (10) that widens the loading area of the carrying surface (5) by extending towards the interior of the rack (3) such that at least some portion is seated on the carrying surface (5) by sliding the pin (9) inside the slot (8) towards the interior of the rack (3) and wherein more than one flange (6) disposed at two opposite sides of the carrying surface (5) and which extends upwards from the carrying surface (5) and wherein the slot (8) located on the flange (6) and the pin (9) that is inserted into the slot (8) such that the auxiliary element (10) remains between the flanges (6) and wherein the slot (8) is hollow and wherein the slot (8) that is inclined with respect to the carrying surface (5).

8. The dishwasher (1) as in claim 7, further comprising a skirt (11) that is located on the side of the auxiliary element (10) facing the interior of the rack (3) and which extends upwards.

9. The dishwasher (1) as in claim 8, further comprising more than one protrusion (12) situated on the auxiliary element (10) which enables the cutlery items to be placed therebetween.

10. A dishwasher (1) comprising—a body (2),—at least one rack (3) placed into the body (2), having a base and side walls (4) surrounding the base and wherein the objects to be washed are placed,—at least one shelf (7), mounted to the side walls (4) of the rack (3), having a carrying surface (5) whereon kitchenware like cups, glasses etc can be placed, characterized by—at least one slot (8) with both ends closed, located on the shelf (7) and—an auxiliary element (10) having at least one pin (9) that can both rotate and slide inside the slot (8), that is folded over the carrying surface (5) by being rotated around the pin (9) when the pin (9) is rested against any end of the slot (8) and wherein the auxiliary element (10) that widens the loading area of the carrying surface (5) by extending towards the interior of the rack (3) such that at least some portion is seated on the carrying surface (5) by sliding the pin (9) inside the slot (8) towards the interior of the rack (3) and wherein more than one flange (6) disposed at two opposite sides of the carrying surface (5) and which extends upwards from the carrying surface (5) and wherein more than one flange (6) disposed at two opposite sides of the carrying surface (5) and which extends upwards from the carrying surface (5) and wherein the slot (8) located on the flange (6) and the pin (9) that is inserted into the slot (8) such that the auxiliary element (10) remains between the flanges (6) and wherein the slot (8) which is located at the inner surface of the flange (6) and wherein the slot (8) that is inclined with respect to the carrying surface (5).

11. The dishwasher (1) as in claim 10, further comprising a skirt (11) that is located on the side of the auxiliary element (10) facing the interior of the rack (3) and which extends upwards.

12. The dishwasher (1) as in claim 11, further comprising more than one protrusion (12) situated on the auxiliary element (10) which enables the cutlery items to be placed therebetween.

* * * * *